US008866643B2

(12) United States Patent
Sano

(10) Patent No.: US 8,866,643 B2
(45) Date of Patent: Oct. 21, 2014

(54) ROTATION INPUT DEVICE

(75) Inventor: Tadashi Sano, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 651 days.

(21) Appl. No.: 13/220,362

(22) Filed: Aug. 29, 2011

(65) Prior Publication Data

US 2012/0056761 A1 Mar. 8, 2012

(30) Foreign Application Priority Data

Sep. 7, 2010 (JP) ..... 2010-199749

(51) Int. Cl.

| | |
|---|---|
| ***H03K 17/94*** | (2006.01) |
| ***H03M 11/00*** | (2006.01) |
| ***E05B 45/06*** | (2006.01) |
| ***E05B 49/00*** | (2006.01) |
| ***E05B 43/00*** | (2006.01) |
| ***H04M 1/00*** | (2006.01) |
| ***H04M 3/00*** | (2006.01) |
| ***G05G 1/08*** | (2006.01) |

(52) U.S. Cl.

CPC ..... *G05G 1/08* (2013.01)
USPC ..... 341/35; 340/542; 70/278.4; 70/272; 70/274; 379/358; 379/362; 379/368

(58) Field of Classification Search

CPC . G06F 3/0362; G06F 3/0338; G06F 3/04847; G07C 9/00666; E05B 47/0012; F16C 32/0436; H02K 7/09; H02K 33/16; G01D 5/20; G01D 5/145; G01R 15/20
USPC ..... 341/35; 340/542; 70/278.4, 272–274; 379/358, 362–368
See application file for complete search history.

(56) References Cited

U.S. PATENT DOCUMENTS

| | | | | |
|---|---|---|---|---|
| 2,375,179 | A * | 5/1945 | O'D Shepherd | 341/35 |
| 4,779,075 | A * | 10/1988 | Zagelein et al. | 340/870.18 |
| 4,970,512 | A * | 11/1990 | Wood | 341/35 |
| 5,450,075 | A * | 9/1995 | Waddington | 340/870.28 |
| 5,619,110 | A * | 4/1997 | Sugimoto et al. | 318/450 |
| 5,640,862 | A * | 6/1997 | Remenicky | 70/278.4 |
| 5,656,867 | A * | 8/1997 | Kokubu | 307/10.5 |
| 5,870,914 | A * | 2/1999 | Dawson | 340/5.55 |

FOREIGN PATENT DOCUMENTS

| | | |
|---|---|---|
| DE | 10 2007 042 113 A1 | 3/2009 |
| JP | 2005-019113 | 1/2005 |

OTHER PUBLICATIONS

Office Action mailed Apr. 30, 2012 for German Patent Application No. 10 2011 082 127.9.

* cited by examiner

*Primary Examiner* — Daniel Wu
*Assistant Examiner* — Emily C Terrell
(74) *Attorney, Agent, or Firm* — Hunton & Williams LLP

(57) ABSTRACT

In a rotation input device, a planetary carrier, connected to an operation knob, rotatably supports a planetary gear which meshes with an outer teeth row provided for a sun gear, to which an output shaft is secured, and also meshes with an inner teeth row provided for an outer gear. A plunger provided for the sun gear is in elastic contact with a recess cam provided for the outer gear. A solenoid unit prevents rotation of the outer gear in accordance with an output of a magnetic sensor which faces a magnet provided for the output shaft.

14 Claims, 8 Drawing Sheets

ROTATION INPUT DEVICE

CLAIM OF PRIORITY

This application claims benefit of Japanese Patent Application No. 2010-199749 filed on Sep. 7, 2010, the entire contents of which is hereby incorporated by reference.

BACKGROUND OF THE DISCLOSURE

1. Field of the Disclosure

The present disclosure relates to a rotation input device.

2. Description of the Related Art

Input devices included in in-vehicle apparatuses, such as a car navigation system, a car audio system, and a car air conditioning system, include rotation input devices each including an operation knob that is rotated about a single shaft. An operator rotates the operation knob, thereby inputting a proper instruction to such an in-vehicle apparatus.

In some rotation input devices, when the operator rotates the operation knob, an electromagnetic brake applies a braking force to the operation knob in accordance with a rotation position of the operation knob, thus allowing the operator to recognize an operation range and operation limits.

For example, Japanese Unexamined Patent Application Publication No. 2005-19113 discloses a tactile force applying input device in which when an operation knob is rotated beyond its operation range, an electromagnetic brake prevents rotation of the operation knob and provides a tactile barrier to the operator.

In this case, when the operator intends to rotate the operation knob in the opposite direction, the electromagnetic brake has to be released. If the operation knob is completely locked, it is difficult to determine a direction in which the operation knob is to be rotated. Disadvantageously, the electromagnetic brake cannot be released. The above-described tactile force applying input device therefore includes an elastic member disposed at the middle of a drive shaft so that the operation knob is rotatable when the electromagnetic brake applies a braking force. Thus, the operator can determine the direction in which the operation knob is to be rotated.

In the above-described tactile force applying input device disclosed in Japanese Unexamined Patent Application Publication No. 2005-19113, while the electromagnetic brake prevents the drive shaft from rotating, if the operation knob is further rotated in the same direction as the direction in which the drive shaft was rotated until the rotation was prevented, the elastic member is elastically deformed, so that the operator can feel a tactile barrier. After that, when the operator rotates the operation knob in the opposite direction, a rotary encoder detects the angle and direction of rotation of the operation knob and the prevention of the drive shaft rotation by the electromagnetic brake is released, so that the operation knob is unlocked.

If the operator, who has felt the tactile barrier, rotates the operation knob in the opposite direction by a small angle, the rotary encoder cannot detect the angle of rotation (hereinafter, referred to as a "rotation angle") of the operation knob in the opposite direction and the direction of rotation (hereinafter, referred to as a "rotation direction"). Unfortunately, the drive shaft is continuously prevented from rotating by the electromagnetic brake and the locked operation knob is not unlocked.

These and other drawbacks exist

SUMMARY OF THE DISCLOSURE

The present disclosure has been made in consideration of the above-described circumstances. Embodiments of the present disclosure provide a rotation input device in which the rotation angle of a rotary operation member and a change of the rotation direction are detected with high sensitivity.

According to an exemplary embodiment, a rotation input device includes a rotary operation member, a first rotary member configured to rotate concentrically with and indirectly relative to the rotary operation member, a rotation detecting unit for detecting rotation of the first rotary member, a second rotary member configured to be rotatable concentrically with the rotary operation member, a holding unit disposed between the second rotary member and the rotary operation member, the holding unit being configured to, while the second rotary member is not prevented from rotating, allow the rotary operation member and the second rotary member to rotate in unison, while the second rotary member is prevented from rotating, generate drag as the rotary operation member is allowed to rotate from a predetermined position to another position in the same direction as a direction in which the second rotary member was rotated until the rotation was prevented, and when a force applied to the rotary operation member is removed or the rotary operation member is rotated in the opposite direction, allow the rotary operation member to return from the other position to the predetermined position, a braking unit for stopping the rotation of the second rotary member when an output of the rotation detecting unit exceeds an operation range of the rotary operation member, a controller for releasing driving the braking unit when determining on the basis of an output of the rotation detecting unit that the rotation direction of the rotary operation member is reversed while the rotation of the second rotary member is prevented by the braking unit, a planetary gear support configured to rotate concentrically with and in unison with the rotary operation member and rotatably support a planetary gear, an inner teeth row, provided for the second rotary member, configured to mesh with the planetary gear, and an outer teeth row, provided for the first rotary member, configured to mesh with the planetary gear.

With such a configuration, under condition that the braking unit is driven to prevent the rotation of the second rotary member, when an operator rotates the rotary operation member from the predetermined position to another position in the same direction as the direction in which the second rotary member was rotated until the rotation was prevented, while drag, namely, a tactile barrier is applied to the rotary operation member, the rotary operation member is rotated in unison with the planetary gear support such that the planetary gear revolves, so that the first rotary member is rotated relative to the planetary gear support at an increased speed in the same direction as the direction in which the planetary gear support is rotated. After that, when a force applied to the rotary operation member is removed or the rotary operation member is rotated in the opposite direction, while the rotary operation member is returned from the other position to the predetermined position, the rotary operation member and the planetary gear support are rotated in unison in the opposite direction such that the planetary gear revolves, so that the first rotary member is rotated relative to the planetary gear support at an increased speed in the same direction as the direction in which the planetary gear support is rotated. As described above, the first rotary member is rotated relative to the planetary gear support at an increased speed. If the rotary operation member is rotated in the opposite direction by a small angle, the rotation detecting unit can detect the rotation angle of the first rotary member and a change of the rotation direction with high sensitivity. In this case, the planetary gear supported by the planetary gear support, the second rotary member which includes the inner teeth row configured to mesh with the planetary gear and is prevented from rotating while meshing with the planetary gear, and the first rotary member which includes the outer teeth row configured to mesh with the planetary gear and is freely rotatable operate as a planetary gear mechanism.

In such an embodiment, the rotation input device may further include a third rotary member configured to rotate concentrically with and in unison with the first rotary member. The outer teeth row may be provided for the third rotary member. The second rotary member and the third rotary member may be arranged on the same plane. With this arrangement, the profile of the device in a direction along the axis of rotation of the device can be lowered.

Also, the holding unit may include a cam member provided for either one of the second rotary member and the third rotary member and a driving member, provided for the other one of the second rotary member and the third rotary member, in elastic contact with the cam member.

With this arrangement, properly setting the size of each of the cam member and the driving member allows the angle range of the rotary operation member which is permitted to rotate under condition that the second rotary member is prevented from rotating, namely, play to be set small, thus improving operation feeling.

In a device according to various embodiments, the planetary gear may be one of a plurality of planetary gears circumferentially spaced at equal angular intervals and the cam member and the driving member may be arranged between the planetary gears.

In these embodiments, the profile of the device in the direction along the axis of rotation of the device can be further lowered.

Also, restricting walls having an angle of inclination (hereinafter, referred to as an "inclination angle") larger than that of a cam face constituting the cam member may be arranged on both sides of the cam member.

Furthermore, the angle range of play can be accurately set with a simple configuration, thus improving the operation feeling.

In these embodiments, the other one of the second rotary member and the third rotary member may include protruding portions protruding around the driving member such that the protruding portions are locked by the restricting walls. With this arrangement, if a large force is applied to the rotary operation member prevented from rotating, the rotation of the rotary operation member can be reliably prevented without causing damage on components. Thus, the device offers high reliability.

The braking unit may include an armature configured to rotate in unison with the second rotary member and be displaceable in the axial direction of the device and a solenoid unit configured to attract the armature in the axial direction. With this arrangement, the rotation of the second rotary member can be stably prevented. Thus, the device offers higher reliability.

DETAILED DESCRIPTION OF THE DISCLOSURE

The following description is intended to convey a thorough understanding of the embodiments described by providing a number of specific embodiments and details involving a rotation input device. It should be appreciated, however, that the present invention is not limited to these specific embodiments and details, which are exemplary only. It is further understood that one possessing ordinary skill in the art, in light of known systems and methods, would appreciate the use of the invention for its intended purposes and benefits in any number of alternative embodiments, depending on specific design and other needs.

Figure 1:
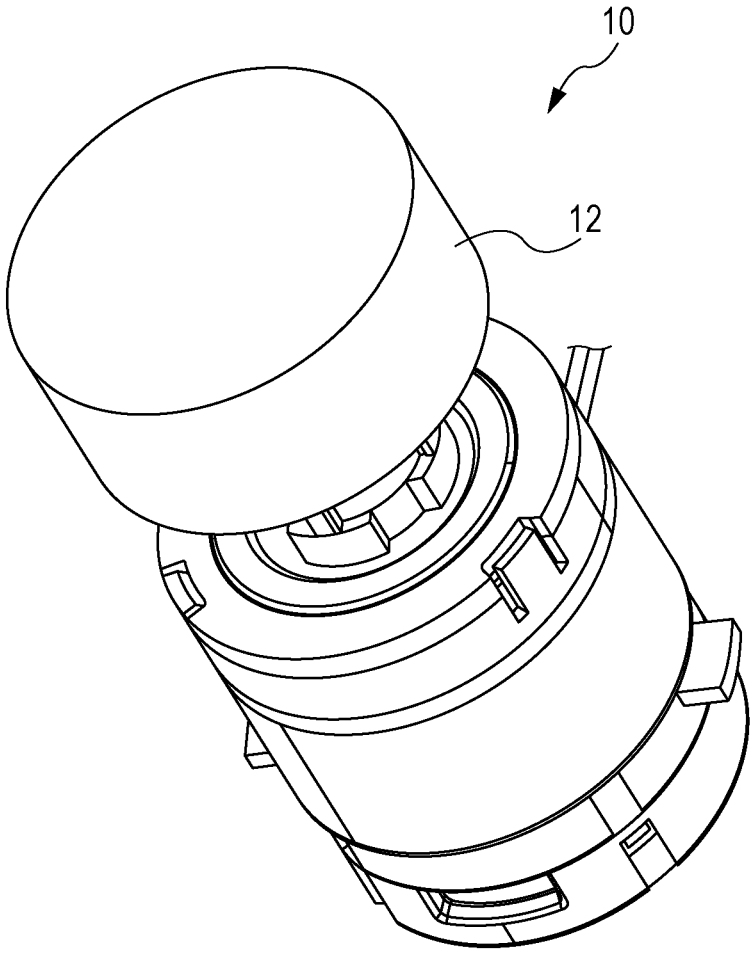
FIG. 1 is a schematic perspective view of a rotation input device according to an embodiment of the disclosure.

FIG. 1 is a schematic perspective view of a rotation input device 10 according to an exemplary embodiment of the disclosure. The rotation input device 10 may be used as an input device of, for example, a car air conditioning system and may be installed on an instrument panel or a center console in a vehicle interior.

The rotation input device 10 may include an operation knob 12, serving as a rotary operation member. An operator may rotate the operation knob 12 to select an operating condition of the car air conditioning system.

Figure 2:
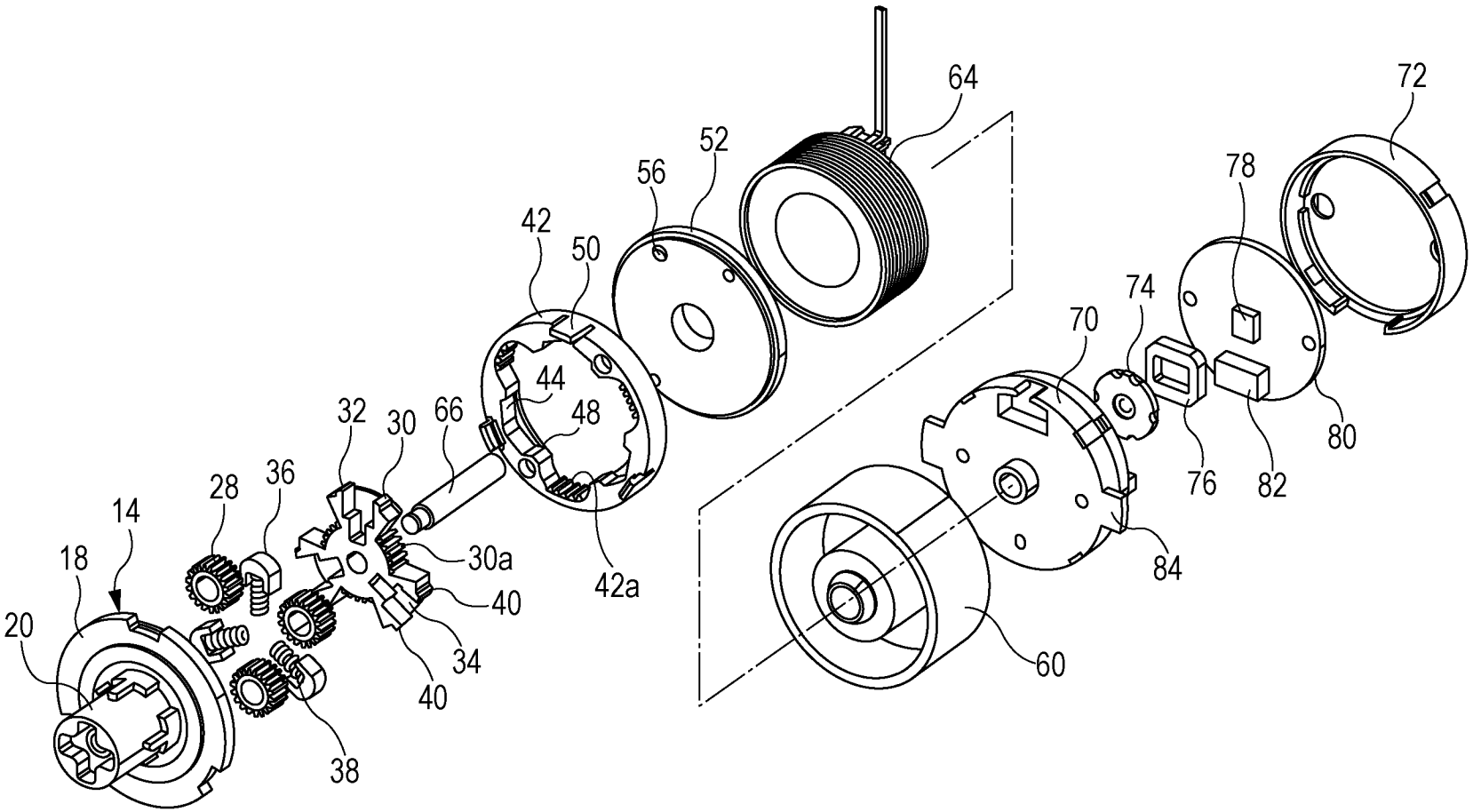
FIG. 2 is a schematic exploded perspective view of the rotation input device of FIG. 1, an operation knob being omitted.
Figure 3:
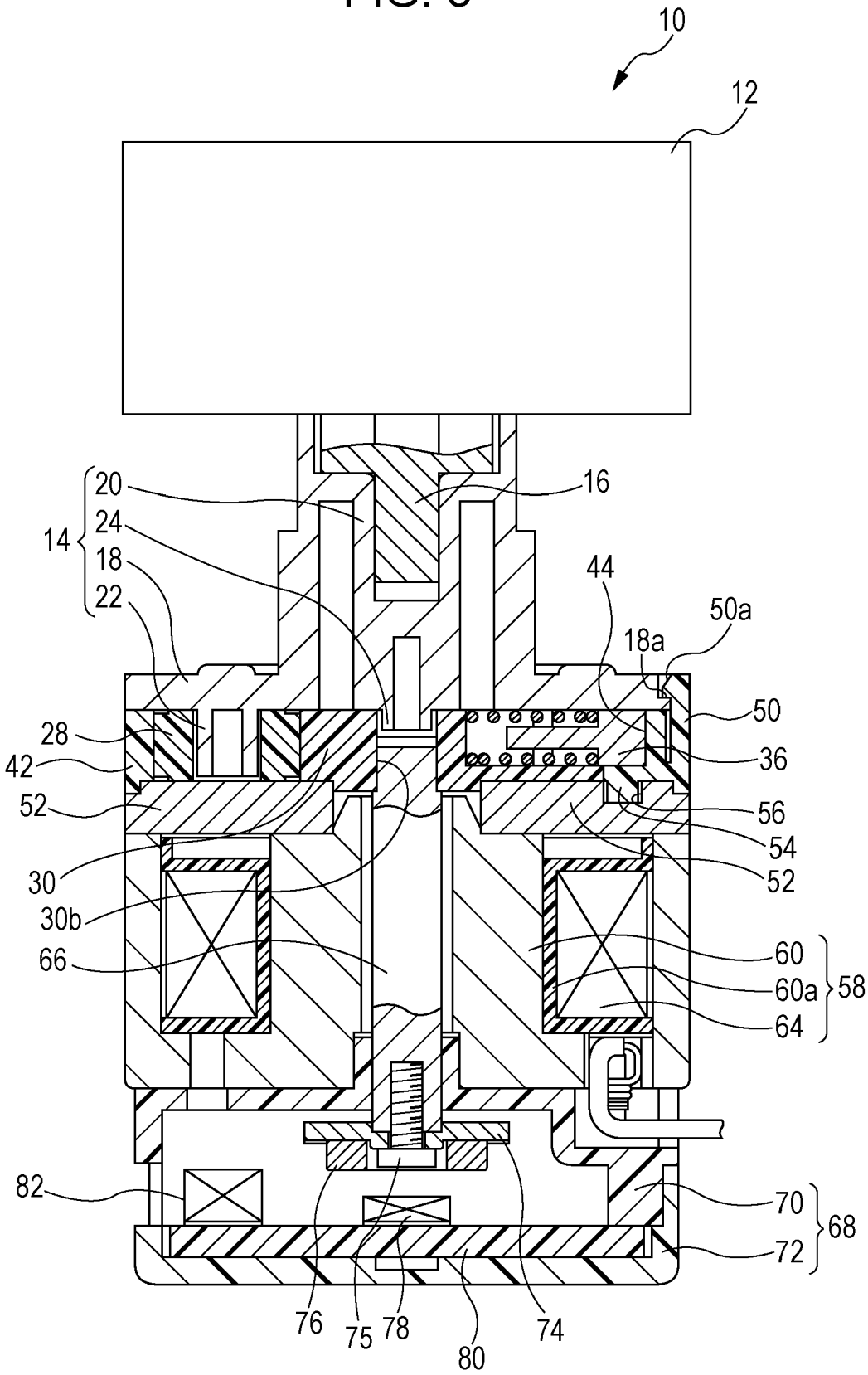
FIG. 3 is a schematic longitudinal sectional view of the rotation input device of FIG. 1.

FIG. 2 is a schematic exploded perspective view of the rotation input device 10, the operation knob 12 being omitted. FIG. 3 is a schematic longitudinal sectional view of the rotation input device 10.

The operation knob 12 may be connected to a planetary carrier 14 such that the planetary carrier 14 may rotate concentrically with and in unison with the operation knob 12. The planetary carrier 14 may serve as a planetary gear support configured to rotatably support planetary gears 28.

Specifically, the operation knob 12 may include a connection shaft 16 connected to the planetary carrier 14. The planetary carrier 14 may include a disc 18 having a first surface facing the operation knob 12 and a second surface facing away from the operation knob 12, a connection cylinder 20, gear shafts 22, and a rotating shaft 24 such that the connection cylinder 20 may project from the first surface of the disc 18 and the gear shafts 22 and the rotating shaft 24 project from the second surface thereof.

The connection shaft 16 of the operation knob 12 may be connected to the connection cylinder 20 of the planetary carrier 14 by, for example, a tapping screw.

The gear shafts 22 may be spaced at intervals of 120° about the rotating shaft 24.

The gear shafts 22 also may rotatably support planetary gears 28, respectively.

Figure 6:
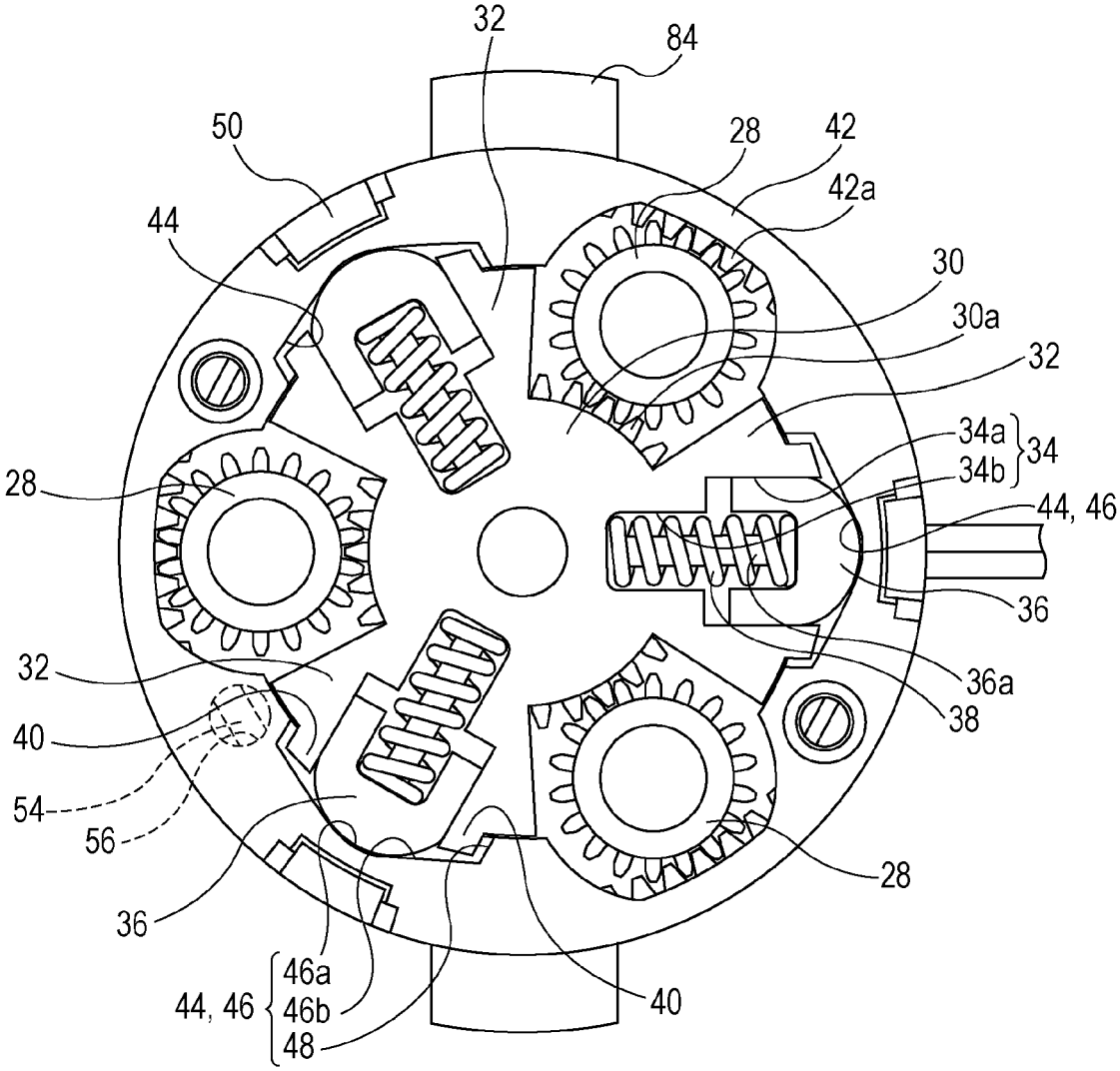
FIG. 6 is a schematic plan view of the rotation input device of FIG. 1 when the electromagnetic brake is not activated, the operation knob and a planetary carrier being omitted.

Referring to FIG. 6, the three planetary gears 28 may mesh with inner teeth rows 42*a* may be arranged on an outer gear 42, serving as a second rotary member, and mesh with outer teeth rows 30*a* arranged on a sun gear 30, serving as a third rotary member. The planetary gears 28, the sun gear 30, and the outer gear 42 may constitute a planetary gear mechanism.

As illustrated in FIG. 3, an output shaft 66, serving as a first rotary member which will be described later, may be secured in lower part of a shaft hole 30*b* at the center of the sun gear 30 such that the output shaft 66 is concentric with the sun gear 30 and the rotating shaft 24 of the planetary carrier 14 may be rotatably fitted in upper part of the shaft hole 30*b*. Accordingly, the output shaft 66 may be provided such that the output shaft 66 may rotate concentrically with and indirectly relative to the operation knob 12. The outer gear 42 may be generally ring-shaped and may be rotatable concentrically with the output shaft 66.

Referring to FIG. 6, the sun gear 30 may include projecting bases 32 each disposed between the adjacent outer teeth rows 30*a* of the three outer toothed rows 30*a* such that the projecting bases 32 radially outwardly project beyond the outer teeth rows 30*a*. Each projecting base 32 may have a recess 34. The recess 34 may extend in the radial direction of the sun gear 30 such that the recess may be opened outwardly in the radial direction.

Each recess 34 may receive a plunger 36 and a helical compression spring 38 which may constitute a driving member. The plunger 36 may be constantly urged outward by the helical compression spring 38 such that the plunger 36 is in elastic contact with a recess cam 44, serving as a cam member which will be described later.

The plunger 36 may include a shaft 36*a* around which the helical compression spring 38 is disposed. The recess 34 may include an outer recess part 34*a*, an inner recess part 34*b*, and a step part positioned between the parts 34*a* and 34*b* arranged in the radial direction of the sun gear 30. The recess 34 may be shaped such that the width of the outer recess part 34*a* is wider than that of the inner recess part 34*b*. The plunger 36 may be in sliding contact with the outer recess part 34*a* such that the plunger is reciprocatable within the part. Protrusions 40, serving as protruding portions, protruding outward in the radial direction, may be arranged on both sides of each recess 34. The protrusions 40 may be configured to restrict the angle range of play which will be described later.

Referring to FIG. 6, the outer gear 42 may have three recess cams (cam members) 44 arranged on the inner surface thereof. The top ends of the plungers 36 arranged in the projecting bases 32 may be in contact with the recess cams 44, respectively.

Each recess cam 44 may have a cam face 46 which the top end of the plunger 36 is in elastic and sliding contact with. The cam face 46 may include a valley 46*a* positioned at the middle thereof and a pair of inclined sections 46*b* arranged on both sides of the valley 46*a*. The recess cams 44 may be designed such that the distance between the center of rotation of the sun gear 30 and the cam face 46 may be the longest at the middle of the cam face 46 and may be gradually reduced toward both the ends thereof.

Restricting faces 48, serving as restricting walls having an inclination angle larger than that of each inclined section 46*b* may be arranged on both sides of each cam face 46. When the outer gear 42 is prevented from rotating, the restricting faces 48 arranged on both the sides of each plunger 36 define the angle range within which the sun gear 30 (the operation knob 12 and the planetary carrier 14) is rotatable relative to the outer gear 42. For example, when the sun gear 30 is rotated in one direction, the sun gear 30 may be rotatable relative to the outer gear 42 in an angle range from an angle at which the top end of each plunger 36 is fitted in the corresponding valley 46*a* to an angle at which the side surface of each protrusion 40 abuts against the corresponding restricting face 48. This angle range may correspond to play, indicated at $\Delta\theta n$ in FIG. 8. When the sun gear 30 is rotated in the opposite direction, play may be similarly provided. With this arrangement, if a large force is applied to the operation knob 12 prevented from rotating, the rotation of the operation knob 12 can be reliably prevented without causing damage on the components. Also, the rotation input device 10 can offer high reliability.

The recess cams 44, the plungers 36, and the helical compression springs 38, constituting a holding unit, may be arranged between the outer gear 42 (the second rotary member) and the operation knob 12 (the rotary operation member). While the outer gear 42 is not prevented from rotating, each plunger 36 may be received in the valley 46*a* of the corresponding recess cam 44. When the operation knob 12 is rotated, therefore, the outer gear 42 may be rotated in unison with the operation knob 12.

While the outer gear 42 is prevented from rotating, as the operation knob 12 is rotated from a predetermined position to another position, the top end of each plunger 36 may be moved from the valley 46*a* of the corresponding cam face 46 toward the restricting face 48 such that the top end climbs the inclined section 46*b*, thus generating drag (a force serving as a tactile barrier). After that, when a force applied to the operation knob 12 is removed or the operation knob 12 is rotated in the opposite direction, the operation knob 12 may be returned from the other position to the predetermined position. In this case, the drag may be caused by the elasticity of the helical compression spring 38 compressed when the top end of each plunger 36 may be moved from the valley 46*a* of the cam face 46 to the restricting face 48. On the other hand, a force returning the operation knob 12 to the predetermined position may be caused by an urging force applied to the inclined section 46*b* by the compressed helical compression spring 38 which tends to expand.

Referring to FIG. 3, the outer gear 42 may be disposed between the planetary carrier 14 and an armature 52. The outer gear 42 may have three engagement protrusions 50 upwardly extending from the periphery thereof in FIG. 3. Each engagement protrusion 50 may include a hook 50*a* at the top end thereof such that the hook inwardly extends in the radial direction. The hooks 50*a* may be engaged with notches 18*a* arranged on the upper surface of the disc 18 (the planetary carrier 14), respectively.

To provide the above-described play, the width of each notch 18*a* in the circumferential direction of the disc 18 may be wider than that of the hook 50*a* of each engagement protrusion 50. Accordingly, the outer gear 42 and the planetary carrier 14 may be rotatable relative to each other in an angle range equivalent to at least double the play.

A connecting protrusion 54 extending from the outer gear 42 toward the armature 52 may be fitted in a connection hole 56 disposed in the armature 52. With this arrangement, the armature 52 may be rotated in unison with the outer gear 42. If the armature 52 is attracted by a solenoid unit 58, the armature 52 may be displaced in the axial direction of the rotation input device 10 to stop the rotation of the outer gear 42.

The armature 52, made of a soft magnetic material, may be configured to be electromagnetically attracted by the solenoid unit 58. The armature 52 and the solenoid unit 58 constitute a braking unit (electromagnetic brake).

The solenoid unit 58 may include a yoke core 60 which may be made of a soft magnetic material and may include a receiving portion 60*a*, and a coil (solenoid) 64 received in the receiving portion 60*a*.

When current is supplied to the coil 64, the armature 52 may be attracted to the yoke core 60 by a magnetic force generated in the coil 64, so that the armature 52 may be brought into contact with the yoke core 60 with contact pressure corresponding to the magnetic force. When the operation knob 12 is rotated, this contact pressure may become a friction force caused between the armature 52 and the yoke core 60, namely, a braking force to prevent the rotation of the outer gear 42.

The output shaft 66 which may be secured to the shaft hole 30*b* of the sun gear 30 may be configured to detect the rotation of the operation knob 12. Referring to FIG. 3, the output shaft 66 may extend through a central portion of the yoke core 60 and the center hole of an upper casing 70, which constitutes a housing 68. One extending end of the output shaft 66 may be received in the housing 68.

A magnet 76 may be affixed to a back yoke 74 secured to one end of the output shaft 66 by a screw 75. The housing 68 may include the upper casing 70 and a lower casing 72. The upper casing 70 may be affixed to the lower surface of the yoke core 60.

A circuit board 80 may be attached to the lower casing 72. A magnetic sensor (e.g., a giant magnetoresistive (GMR) sensor) 78 may be disposed on the circuit board 80 such that the magnetic sensor 78 faces the magnet 76. The magnetic sensor 78 may output a signal responsive to the rotation of the output shaft 66 to the outside through a connector 82 attached to the circuit board 80. The magnet 76 and the magnetic sensor 78 may constitute a rotation detecting unit.

Referring to FIG. 2, the upper casing 70 may include two fixing tabs 84 protruding outward. The housing 68 may be affixed to the instrument panel or the center console using the fixing tabs 84.

Figure 4:
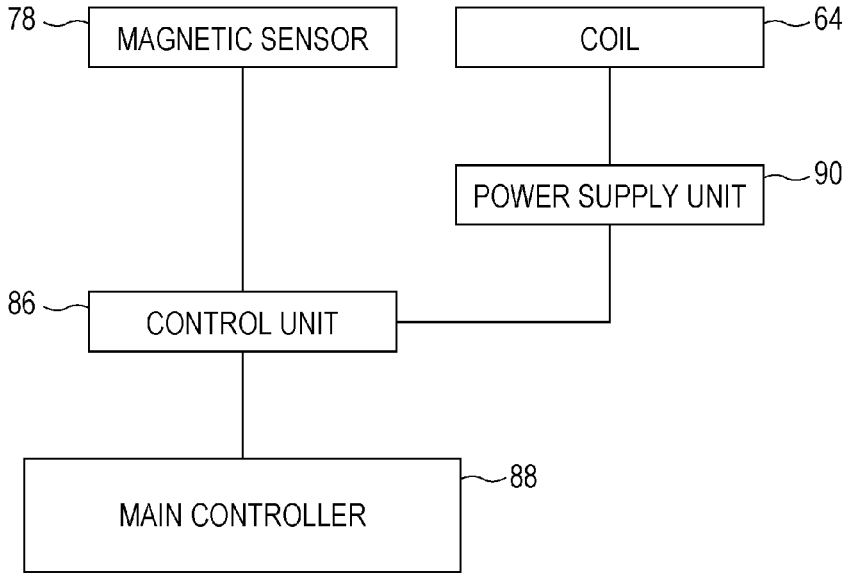
FIG. 4 is a schematic block diagram explaining the circuit configuration of the rotation input device of FIG. 1.

Referring to FIG. 4, the rotation input device 10 may include a control unit 86, serving as a controller for controlling an operation of the rotation input device 10. The control unit 86 may include, for example, a microcomputer unit (MCU) and may include a central processing unit (CPU), a memory, and the like.

The control unit 86 may be connected to the magnetic sensor 78 (the rotation detecting unit), a main controller 88 of the car air conditioning system, and a power supply unit 90 configured to supply current to the coil 64 (the braking unit). The control unit 86 may control the main controller 88 of the car air conditioning system on the basis of an output of the magnetic sensor 78.

For example, while current is supplied to the coil 64 to prevent the rotation of the outer gear 42, when the control unit 86 determines on the basis of an output of the magnetic sensor 78 that the rotation direction of the operation knob 12 is reversed, the control unit 86 may stop the current supplied to the coil 64 to release driving the solenoid unit 58, thus controlling a braking force acting on the outer gear 42.

Figure 5:
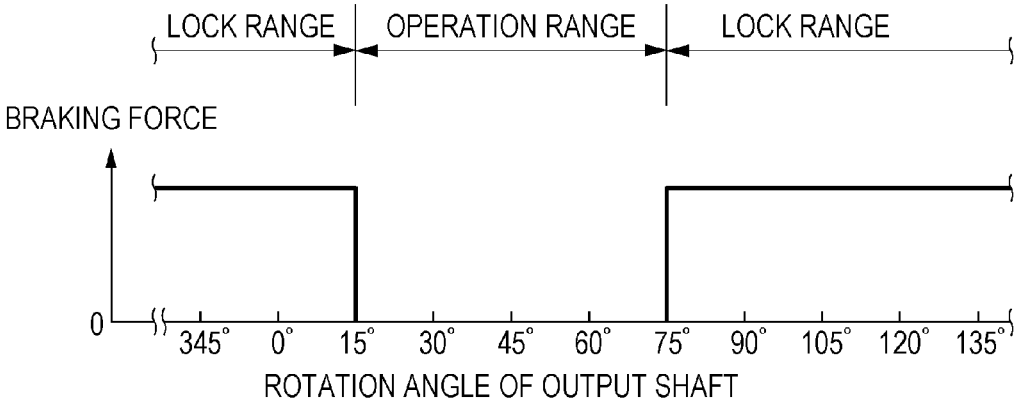
FIG. 5 is a graph explaining the relationship between a braking force of an electromagnetic brake and the rotation angle of the operation knob.

FIG. 5 illustrates the relationship between the rotation angle of the output shaft 66 and the braking force. Referring to FIG. 5, an operation range of the operation knob 12 may correspond to an angle range from approximately 15° to approximately 75° of the output shaft 66 and a lock range thereof may correspond to an angle range from an angle less than approximately 15° to an angle greater than approximately 75°. When the operation knob 12 is rotated into the lock range beyond the operation range, the control unit 86 may supply current to the coil 64 to generate a predetermined braking force. The predetermined braking force may be large enough to prevent the rotation of the outer gear 42 which may rotates in unison with the operation knob 12.

FIG. 6 is a plan view of part of the rotation input device 10 when the rotation angle of the output shaft 66 lies within the operation range.

While the solenoid unit 58 is not activated, the outer gear 42 is not prevented from rotating. As illustrated in FIG. 6, the plungers 36 may be in elastic contact with the valleys 46*a* of the respective recess cams 44. When the operation knob 12 is rotated and the planetary carrier 14 then rotates, therefore, the planetary gears 28 may not rotate but the outer gear 42 and the sun gear 30 may rotate in unison with the planetary carrier 14.

Figure 7:
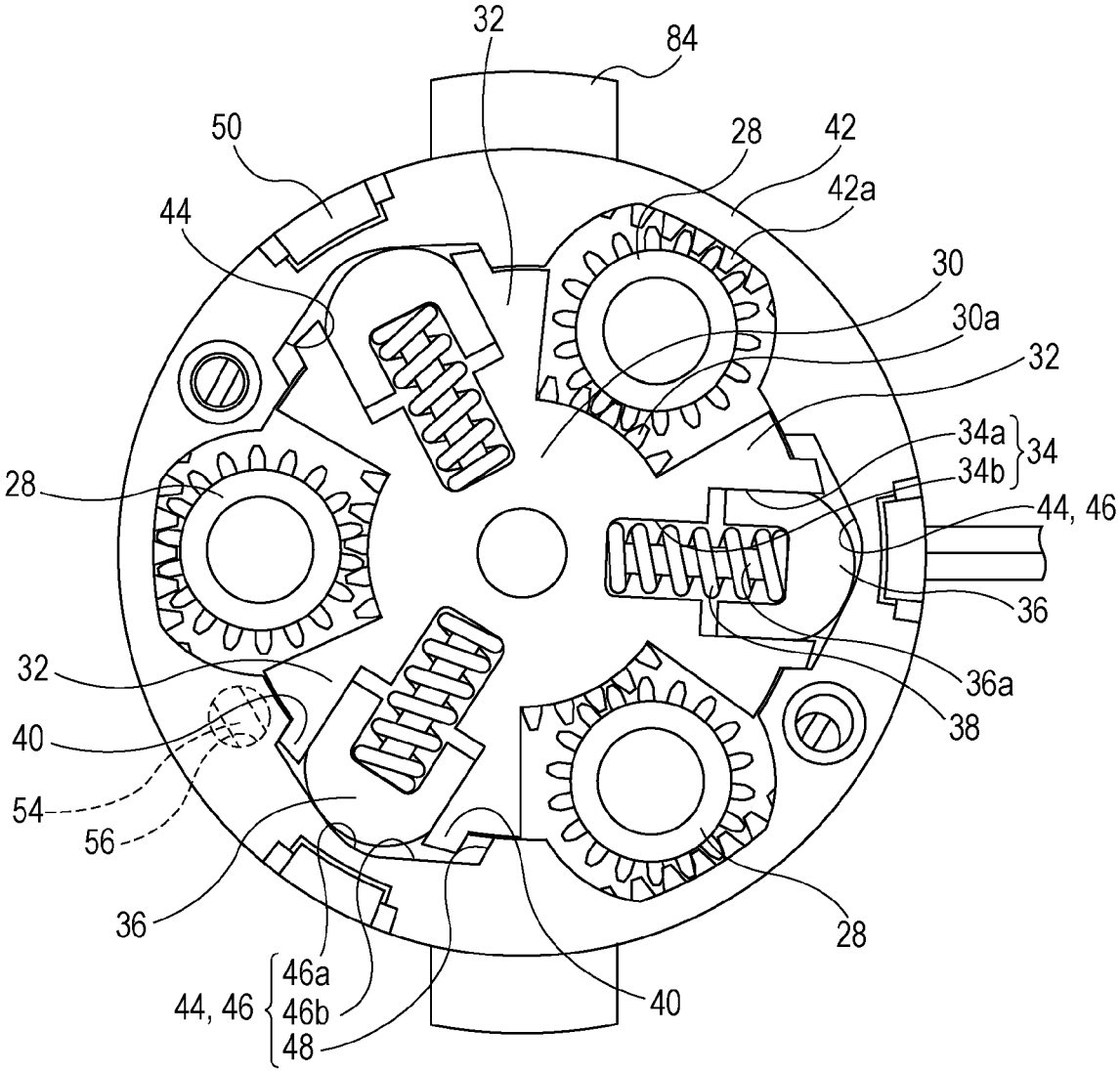
FIG. 7 is a schematic plan view of the rotation input device of FIG. 1 when the operation knob is rotated in a lock direction while the electromagnetic brake is activated, the operation knob and the planetary carrier being omitted.

FIG. 7 is a plan view of a part of the rotation input device 10 when the rotation angle of the output shaft 66 lies within the lock range.

Figure 8:
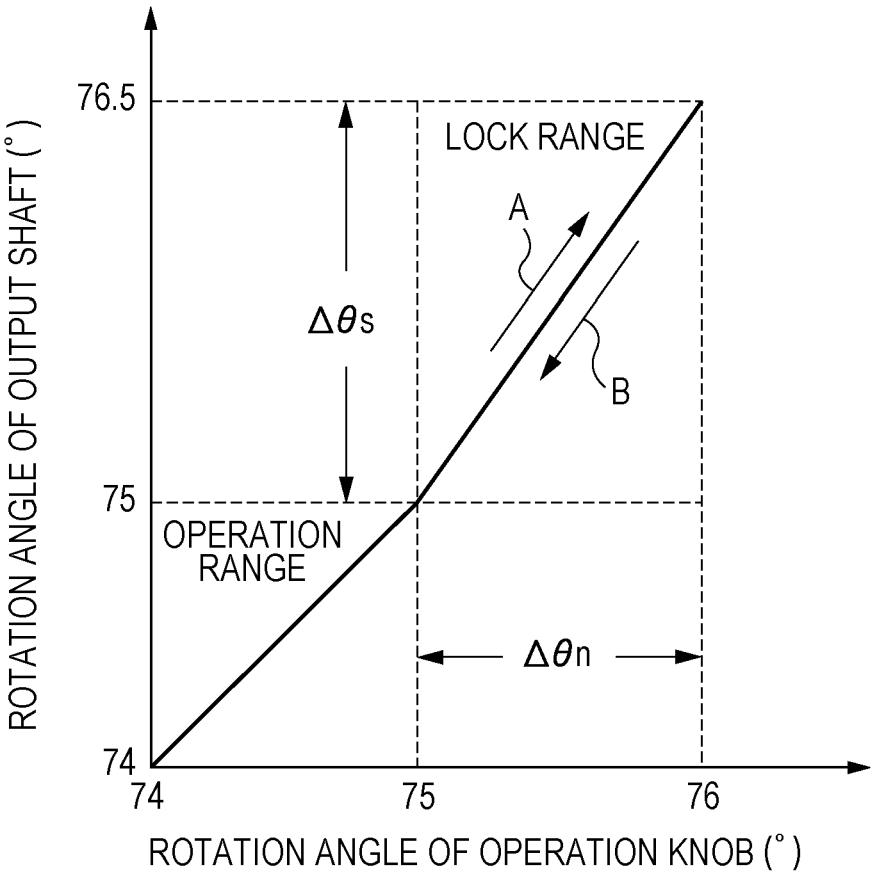
FIG. 8 is a graph explaining the relationship between the rotation angle of the operation knob and that of an output shaft.

When the output shaft 66 is rotated into the lock range beyond the operation range, the control unit 86 may supply current to the coil 64 on the basis of an output of the magnetic sensor 78, thus generating a predetermined braking force to prevent the rotation of the outer gear 42. In this state, when the operator rotates the operation knob 12 in the same direction as the direction in which the output shaft 66 was rotated until the rotation was prevented, namely, in the direction (lock direction) in which the output shaft 66 is moved away from the operation range, the output shaft 66 may be rotated from the predetermined position, illustrated in FIG. 6, to another position illustrated in FIG. 7. Consequently, the operation knob 12 may rotate in unison with the planetary carrier 14, the planetary gears 28 revolve while rotating, so that the sun gear 30 may rotate relative to the planetary carrier 14 at an increased speed as illustrated in FIG. 8.

The rotation angle of the output shaft 66 therefore may be larger than that of the operation knob 12. In this case, the planetary gears 28 supported by the planetary carrier 14, the outer gear 42 prevented from rotating while meshing with the planetary gears 28, and the sun gear 30 which meshes with the planetary gears 28 may operate as the planetary gear mechanism. In the state of FIG. 7, since the top end of each plunger 36 is moved on the inclined section 46*b* from the valley 46*a* toward the restricting face 48, the helical compression spring 38 may be compressed, thus applying drag (tactile barrier) to the operation knob 12.

In the present embodiment, the pitch circles of the planetary gears 28, the outer teeth rows 30*a* of the sun gear 30, and the inner teeth rows 42*a* of the outer gear 42 may be set such that the ratio (speed increasing ratio) of the rotation speed of the planetary carrier 14 to that of the sun gear 30 is 1:1.5. So long as the dimensions of the pitch circles are appropriately selected, therefore, the rotation input device 10 having a desired speed increasing ratio can be achieved.

When the operation knob 12 is further rotated from the state of FIG. 7 in the direction (lock direction) in which the operation knob 12 is rotated away from the operation range, the protrusions 40 of the sun gear 30 may abut against the restricting faces 48 of the outer gear 42, so that the rotation of the operation knob 12 is reliably stopped.

When the operator releases his or her hand from the operation knob 12 to remove a force applied to the operation knob 12 or rotates the operation knob 12 in the opposite direction in the state of FIG. 7, the operation knob 12 and the planetary carrier 14 may be rotated in unison in the opposite direction (counterclockwise in FIG. 7) while the operation knob 12 may be returned from the other position to the predetermined position. Consequently, the planetary gears 28 may revolve, so that the output shaft 66 may be rotated relative to the planetary carrier 14 at an increased speed in the same direction as the rotation direction of the planetary carrier 14. In this case, the planetary gears 28 supported by the planetary carrier 14, the outer gear 42 prevented from rotating while meshing with the planetary gears 28, and the sun gear 30 meshing with the planetary gears 28 may operate as the planetary gear mechanism.

If the operation knob 12 is rotated in the opposite direction by a small angle, therefore, the magnetic sensor 78 can accurately detect the rotation angle of the output shaft 66 and a change of the rotation direction with high sensitivity. A force to return the operation knob 12 to the predetermined position may be generated by an urging force applied to the inclined section 46*b* by the compressed helical compression spring 38 which tends to expand.

FIG. 8 is a graph illustrating the relationship between the rotation angle of the operation knob 12 and that of the output shaft 66 when the operation knob 12 is rotated from the operation range to the lock range. Referring to FIG. 8, an angle of approximately 75° may correspond to an upper limit of the operation range of FIG. 5. In the operation range (from approximately 15° to 75°, the planetary carrier 14 and the sun gear 30 may rotate in unison. Accordingly, the rotation angle of the operation knob 12 may coincide with that of the output shaft 66.

When the operation knob 12 is rotated over 75° into the lock range by 1°, as indicated by the arrow A in FIG. 8, while the outer gear 42 may be prevented from rotating, the output shaft 66 (sun gear 30) rotates to 76.5° by 1.5° at an increased speed higher than that at which the operation knob 12 (planetary carrier 14) rotates. As described above, the amount $\Delta\theta s$ of change in the rotation angle of the output shaft 66 is about 1.5 times as large as the amount $\Delta\theta n$ of change in the rotation angle of the operation knob 12.

Similarly, the output shaft 66 may rotate up to about 13.5° within the lock range adjacent to the lower limit of the operation range.

On the other hand, after the operator rotates the operation knob 12 into the lock range, when the operator releases his or her hand from the operation knob 12 or rotates the operation knob 12 in the opposite direction, the operation knob 12 may rotate in the direction opposite to the lock direction as indicated by the arrow B in FIG. 8, so that the rotation angle of the operation knob 12 may be returned from 76.5° to 75°. The amount $\Delta\theta s$ of change in the rotation angle of the output shaft 66 may be about 1.5 times as large as the amount of $\Delta\theta n$ of change in the rotation angle of the operation knob 12. Since the relationship between the rotation angle of the operation knob 12 and that of the output shaft 66 in a position in the vicinity of an angle of 15° corresponding to a lower limit of the operation range illustrated in FIG. 5 is substantially similar to that in the operation range in FIG. 8, description is omitted.

As described above, in the rotation input device 10 according to this embodiment, the rotation detecting unit (including the magnetic sensor 78 and the magnet 76) may detect the rotation of the output shaft 66 which may rotate concentrically with and indirectly relative to the operation knob 12. The holding unit (including the recess cams 44, the plungers 36, and the helical compression springs 38) may be disposed between the operation knob 12 and the outer gear 42 and may allow the operation knob 12 and the outer gear 42 to rotate in unison when the outer gear 42 is not prevented from rotating. While the outer gear 42 is prevented from rotating, the holding unit may generate drag as the operation knob 12 is allowed to rotate from the predetermined position to another position. When a force applied to the operation knob 12 is removed or the operation knob 12 is rotated in the opposite direction, the holding unit may allow the operation knob 12 to return from the other position to the predetermined position. The braking unit (including the armature 52 and the solenoid unit 58) may stop the rotation of the outer gear 42 when an output of the rotation detecting unit exceeds the operation range of the operation knob 12. The controller (the control unit 86) may release driving the braking unit when determining on the basis of an output of the rotation detecting unit that the rotation direction of the operation knob 12 is reversed while the outer gear 42 is prevented from rotating. The planetary carrier 14 may rotate concentrically with and in unison with the operation knob 12 and may rotatably support the planetary gears 28. The inner teeth rows 42*a* provided for the outer gear 42 and the outer teeth rows 30*a* provided for the output shaft 66 (the teeth rows of the sun gear 30) may mesh with the planetary gears 28.

With this configuration, while the outer gear 42 is prevented from rotating, when the operator rotates the operation knob 12 from the predetermined position to another position, the operation knob 12 and the planetary carrier 14 may be rotated in unison while drag (tactile barrier) is applied to the operation knob 12 such that the planetary gears 28 revolve, so that the output shaft 66 may be rotated relative to the planetary carrier 14 at an increased speed in the same direction as the rotation direction of the planetary carrier 14. After that, when a force applied to the operation knob 12 is removed or the operation knob 12 is rotated in the opposite direction, the operation knob 12 and the planetary carrier 14 may be rotated in unison in the opposite direction such that the planetary gears 28 revolve while the operation knob 12 is returned from the other position to the predetermined position, so that the output shaft 66 may be rotated relative to the planetary carrier 14 at an increased speed in the same direction as the rotation direction of the planetary carrier 14. As described above, the output shaft 66 may be rotated relative to the planetary carrier 14 at an increased speed. If the operation knob 12 is rotated in the opposite direction by a small angle, therefore, the rotation detecting unit can accurately detect the rotation angle of the output shaft 66 and a change of the rotation direction thereof with high sensitivity.

In the present embodiment, the outer teeth rows 30*a* may be arranged on the sun gear 30, which is disposed such that the sun gear 30 may rotate concentrically with and in unison with the output shaft 66, and the outer gear 42 and the sun gear 30 may be arranged on the same plane. With this arrangement, the profile of the device in the direction along the axis of rotation of the device can be lowered.

In various embodiments, the holding unit may include a cam member (including the recess cams 44) provided for either one of the outer gear 42 and the sun gear 30 and a driving member (including the plungers 36 and the helical compression springs 38), provided for the other one, in elastic contact with the cam member. With this arrangement, properly setting the size of each of the cam member and the driving member allows the angle range of the operation knob 12 which is permitted to rotate under condition that the outer gear 42 is prevented from rotating, namely, play to be set small. Thus, operation feeling can be improved.

In these embodiments, a plurality of planetary gears 28 may be circumferentially spaced at equal angular intervals and the cam member and the driving member may be arranged between the planetary gears 28. With this arrangement, the profile of the device in the direction along the axis of rotation of the device can be further lowered.

Also, the restricting walls (restricting faces 48) having an inclination angle larger than that of the cam face constituting the cam member may be provided on both the sides of the cam member. With this arrangement, the angle range of play can be accurately set with a simple configuration, thus improving the operation feeling.

In various embodiments, the other one of the outer gear 42 and the sun gear 30 may include protruding portions (the protrusions 40) protruding around the driving member such that the protruding portions are locked by the restricting wall. With this arrangement, if a large force is applied to the operation knob 12 prevented from rotating, the rotation of the operation knob 12 can be reliably prevented without causing damage on the components. Thus, the rotation input device can offer high reliability.

Also, the braking unit may include the armature 52 which may rotate in unison with the outer gear 42 and may be displaceable in the axial direction of the device and the solenoid unit 58 (including the yoke core 60 and the coil 64) which may attract the armature 52 in the axial direction. With this arrangement, the rotation of the outer gear 42 can be stably prevented. Thus, the rotation input device can offer higher reliability.

The present invention is not limited to the above-described embodiment and includes appropriate modifications of the embodiment.

For example, in the above-described embodiment, the GMR sensor is used to detect the rotation angle of the output shaft 66. A Hall sensor may be used. Alternatively, an optical sensor may be used as a rotation angle detecting unit.

In the above-described embodiment, the restricting faces 48 are provided for the outer gear 42 and the protrusions 40 are provided for the sun gear 30. The restricting faces 48 may be provided for the sun gear 30 and the protrusions 40 may be provided for the outer gear 42.

Figure 9:
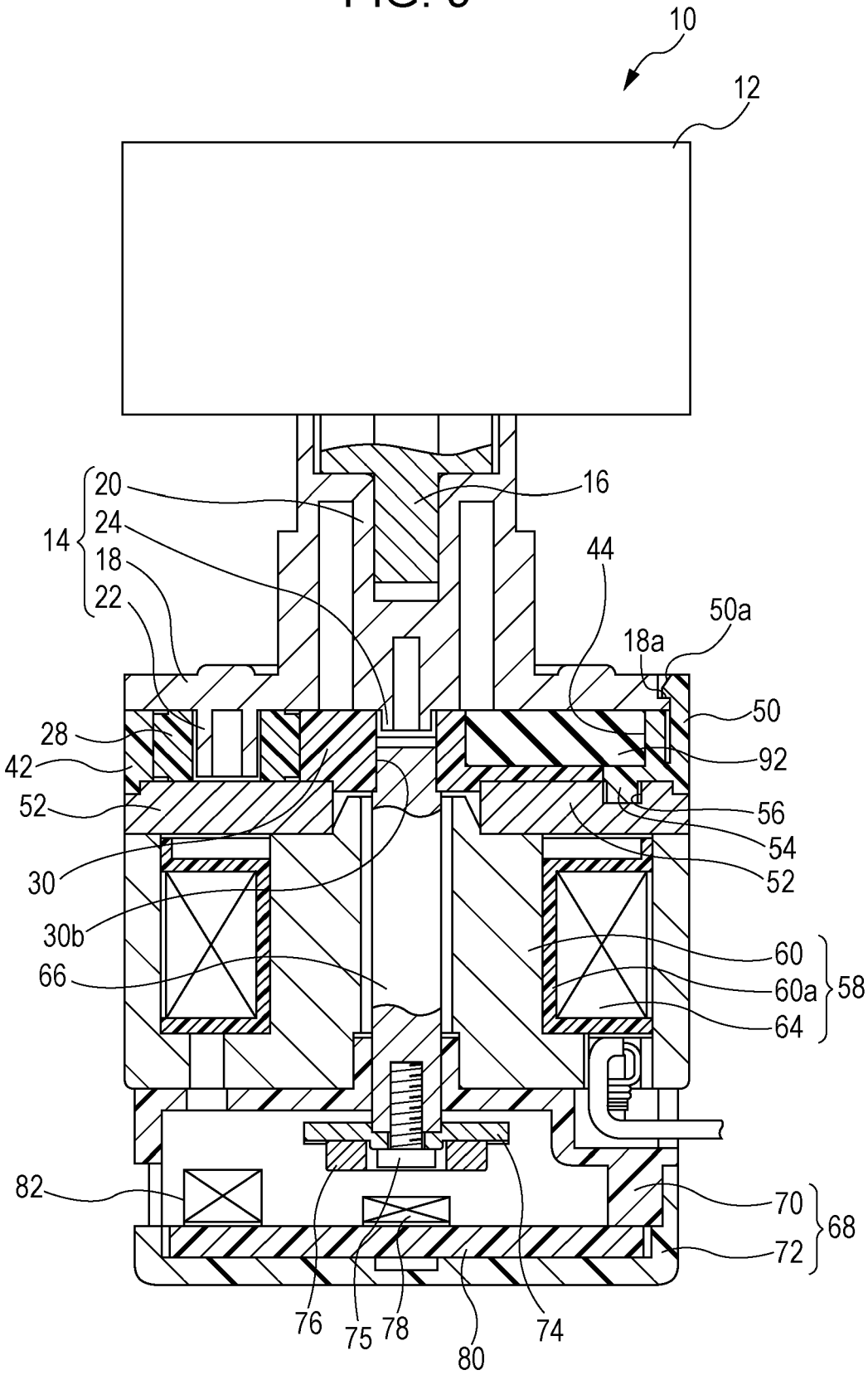
FIG. 9 is a schematic longitudinal sectional view of a rotation input device according to a modification of the embodiment.

In the above-described embodiment, the holding unit includes the recess cams 44, the plungers 36, and the helical compression springs 38. For example, an elastic member 92, made of rubber, extending from the recess 34 to the recess cam 44, as illustrated in FIG. 9, may be used instead of the plunger 36 and the helical compression spring 38. Alternatively, a rubber elastic member may connect the output shaft 66 to the outer gear 42.

The present invention is suitable for an input device for a car air conditioning system. The present invention is also suitable for other apparatuses, e.g., in-vehicle apparatuses, such as a car audio system and a car navigation system. Moreover, the present invention is applicable to a personal computer.

Accordingly, the embodiments of the present inventions are not to be limited in scope by the specific embodiments described herein. Further, although some of the embodiments of the present invention have been described herein in the context of a particular implementation in a particular environment for a particular purpose, those of ordinary skill in the art should recognize that its usefulness is not limited thereto and that the embodiments of the present inventions can be beneficially implemented in any number of environments for any number of purposes. Accordingly, the claims set forth below should be construed in view of the full breadth and spirit of the embodiments of the present inventions as disclosed herein. While the foregoing description includes many details and specificities, it is to be understood that these have been included for purposes of explanation only, and are not to be interpreted as limitations of the invention. Many modifications to the embodiments described above can be made without departing from the spirit and scope of the invention.

What is claimed is:

1. A rotation input device comprising:

a rotary operation member;

a first rotary member configured to rotate concentrically with and indirectly relative to the rotary operation member;

rotation detecting means for detecting rotation of the first rotary member;

a second rotary member configured to be rotatable concentrically with the rotary operation member;

holding means disposed between the second rotary member and the rotary operation member, the holding means being configured to, while the second rotary member is not prevented from rotating, allow the rotary operation member and the second rotary member to rotate in unison, while the second rotary member is prevented from rotating, generate drag as the rotary operation member is allowed to rotate from a predetermined position to another position in the same direction as a direction in which the second rotary member was rotated until the rotation was prevented, and when a force applied to the rotary operation member is removed or the rotary operation member is rotated in the opposite direction, allow the rotary operation member to return from the other position to the predetermined position;

braking means for stopping the rotation of the second rotary member when an output of the rotation detecting means exceeds an operation range of the rotary operation member;

control means for releasing driving the braking means when determining on the basis of an output of the rotation detecting means that the rotation direction of the rotary operation member is reversed while the rotation of the second rotary member is prevented by the braking means;

a planetary gear support configured to rotate concentrically with and in unison with the rotary operation member and rotatably support a planetary gear;

an inner teeth row, provided for the second rotary member, configured to mesh with the planetary gear; and an outer teeth row, provided for the first rotary member, configured to mesh with the planetary gear.

2. The device according to claim 1, further comprising:

a third rotary member configured to rotate concentrically with and in unison with the first rotary member, wherein the outer teeth row is provided for the third rotary member, and the second rotary member and the third rotary member are arranged on the same plane.

3. The device according to claim 2, wherein the holding means includes a cam member provided for either one of the second rotary member and the third rotary member and a driving member, provided for the other one of the second rotary member and the third rotary member, in elastic contact with the cam member.

4. The device according to claim 1, wherein the planetary gear is one of a plurality of planetary gears circumferentially spaced at equal angular intervals, and the cam member and the driving member are arranged between the planetary gears.

5. The device according to claim 3, wherein restricting walls having an inclination angle larger than that of a cam face constituting the cam member are arranged on both sides of the cam member.

6. The device according to claim 5, wherein the other one of the second rotary member and the third rotary member includes protruding portions protruding around the driving member such that the protruding portions are locked by the restricting walls.

7. The device according to claim 1, wherein the braking means includes an armature configured to rotate in unison with the second rotary member and be displaceable in the axial direction of the device and a solenoid unit configured to attract the armature in the axial direction.

8. A rotation input device comprising:

a rotary operation member;

a first rotary member configured to rotate concentrically with and indirectly relative to the rotary operation member;

rotation detector that detects rotation of the first rotary member;

a second rotary member configured to be rotatable concentrically with the rotary operation member;

holding device disposed between the second rotary member and the rotary operation member, the holding device being configured to, while the second rotary member is not prevented from rotating, allow the rotary operation member and the second rotary member to rotate in unison, while the second rotary member is prevented from rotating, generate drag as the rotary operation member is allowed to rotate from a predetermined position to another position in the same direction as a direction in which the second rotary member was rotated until the rotation was prevented, and when a force applied to the rotary operation member is removed or the rotary operation member is rotated in the opposite direction, allow the rotary operation member to return from the other position to the predetermined position;

a brake that stops the rotation of the second rotary member when an output of the rotation detector exceeds an operation range of the rotary operation member;

controller that releases driving the brake when determining on the basis of an output of the rotation detector that the rotation direction of the rotary operation member is reversed while the rotation of the second rotary member is prevented by the brake;

a planetary gear support configured to rotate concentrically with and in unison with the rotary operation member and rotatably support a planetary gear;

an inner teeth row, provided for the second rotary member, configured to mesh with the planetary gear; and an outer teeth row, provided for the first rotary member, configured to mesh with the planetary gear.

9. The device according to claim 8, further comprising:

a third rotary member configured to rotate concentrically with and in unison with the first rotary member, wherein the outer teeth row is provided for the third rotary member, and the second rotary member and the third rotary member are arranged on the same plane.

10. The device according to claim 9, wherein the holding device includes a cam member provided for either one of the second rotary member and the third rotary member and a driving member, provided for the other one of the second rotary member and the third rotary member, in elastic contact with the cam member.

11. The device according to claim 8, wherein the planetary gear is one of a plurality of planetary gears circumferentially spaced at equal angular intervals, and the cam member and the driving member are arranged between the planetary gears.

12. The device according to claim 10, wherein restricting walls having an inclination angle larger than that of a cam face constituting the cam member are arranged on both sides of the cam member.

13. The device according to claim 12, wherein the other one of the second rotary member and the third rotary member includes protruding portions protruding around the driving member such that the protruding portions are locked by the restricting walls.

14. The device according to claim 8, wherein the brake includes an armature configured to rotate in unison with the second rotary member and be displaceable in the axial direction of the device and a solenoid unit configured to attract the armature in the axial direction of the device and a solenoid unit configured to attract the armature in the axial direction.

* * * * *